United States Patent [19]

Seki

[11] Patent Number: 4,840,301

[45] Date of Patent: Jun. 20, 1989

[54] FASTENER CONVEYING APPARATUS FOR FASTENER ASSEMBLING MACHINE

[75] Inventor: Fumio Seki, Toyama, Japan

[73] Assignee: Yoshida Kogyo K. K., Tokyo, Japan

[21] Appl. No.: 88,309

[22] Filed: Aug. 24, 1987

[30] Foreign Application Priority Data

Aug. 26, 1986 [JP] Japan ..... 61-129901[U]

[51] Int. Cl.[4] ..... A41H 37/04

[52] U.S. Cl. ..... 227/139; 227/18

[58] Field of Search ..... 227/15, 18, 31, 119, 227/139

[56] References Cited

U.S. PATENT DOCUMENTS 2,292,223 10/1939 Hansen .
3,750,925 8/1973 Schmidt et al. ..... 227/18
3,815,805 6/1974 Beneteau .
4,019,666 4/1977 Foults .
4,569,470 2/1986 Tanaka .
4,605,150 8/1986 Ikehara ..... 227/115 X

FOREIGN PATENT DOCUMENTS 0148508 7/1985 European Pat. Off. .
2096881A 10/1982 United Kingdom .

*Primary Examiner*—Frank T. Vost
*Assistant Examiner*—James L. Wolfe

[57] ABSTRACT

A fastener conveying apparatus for a fastener assembling machine comprises a chute defining a first passageway for guiding a plurality of fastener members in succession, a guide defining a second passageway joined at one end to a lower end of the first passageway for guiding the fastener members one at a time through the second passageway. A front part of the guide is detachable to open the second passageway along its entire length so that a fastener member jammed in the second passageway can be removed easily by using both hands.

7 Claims, 4 Drawing Sheets

FASTENER CONVEYING APPARATUS FOR FASTENER ASSEMBLING MACHINE

BACKGROUND OF THE INVENTION

1. Field of the Invention

The present invention relates to a machine for assembling a pair of fastener members of a garment fastener, such as a snap fastener, a button and an ornament, with a garment fabric disposed between the two fastener members. More particularly, the invention relates to an apparatus for conveying the fastener members to the fastener assembling machine.

2. Description of the Prior Art

In a fastener-assembling machine, a pair of fastener members of a garment fastener is supported on a lower or die unit and an upper or punch unit, respectively; a punch of the upper unit moves toward a die of the lower unit to join the two fastener members together. The two kinds of fastener members are supplied to the fastener-assembling machine by two separate known conveying apparatus, respectively. The known conveying apparatus for each kind of fastener members comprises a chute defining a first passageway through which the fastener members are to be slidably received in succession, and a guide defining a second passageway through which the fastener members are to be conveyed one by one from a lower end of the chute to a respective one of the upper and lower units. In the known conveying apparatus for supplying the fastener members to the upper unit, a part of the guide is pivotable to open the second passageway so that an upper fastener member jammed in the second passageway can be removed.

With the known conveying apparatus for the upper unit, since the pivotable guide part must be held in open position by one hand while the jammed upper fastener member is being removed out of the second passageway by the other hand, easy removing of the jammed upper fastener member cannot be achieved. Further, since the pivotal movement of the guide part does not suffice to open the lower end of the chute, it is difficult to remove an upper fastener member jammed at the junction between the chute and the guide.

SUMMARY OF THE INVENTION

It is therefore an object of the present invention to provide a fastener conveying apparatus, for a fastener assembling machine, which apparatus enables removing of a jammed upper fastener member with both hands.

Another object of the invention is to provide a fastener conveying apparatus, for a fastener assembling machine, in which apparatus an upper fastener member jammed even at the junction between a chute and a guide can be removed without difficulty.

According to the present invention, a fastener conveying apparatus, for a fastener assembling machine, comprises a chute defining a first passageway through which a plurality of fastener members is slidably received in succession, a pair of spaced guide blocks fixed to a base, and a guide supported on the guide blocks and defining a second passageway joined at one end to a lower end of the second passageway for receiving the fastener members therefrom one at a time to guide it to an upper unit. A front part of the guide is detachable to open the second passageway along its entire length. A part of the chute is detachable to open the first passageway at its lower end contiguous to the junction between the first and second passageways.

Many other advantages, features and additional objects of the present invention will become manifest to those versed in the art upon making reference to the detailed description and the accompanying drawings in which a preferred structural embodiment incorporating the principles of the present invention is shown by way of illustrative example.

DETAILED DESCRIPTION

Figure 1:
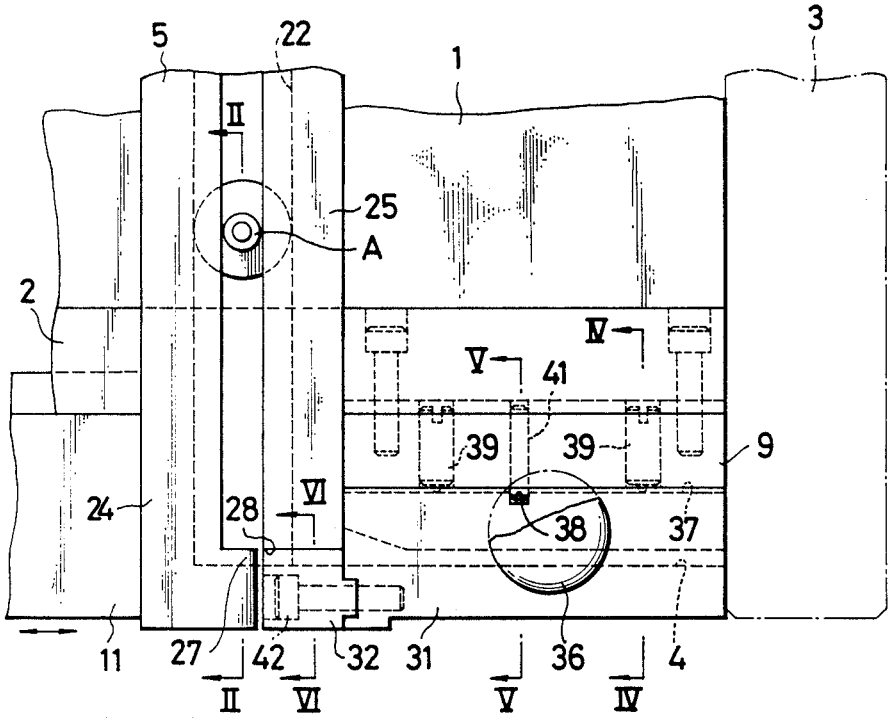
FIG. 1 is a fragmentary front elevational view of an apparatus embodying the present invention.
Figure 2:
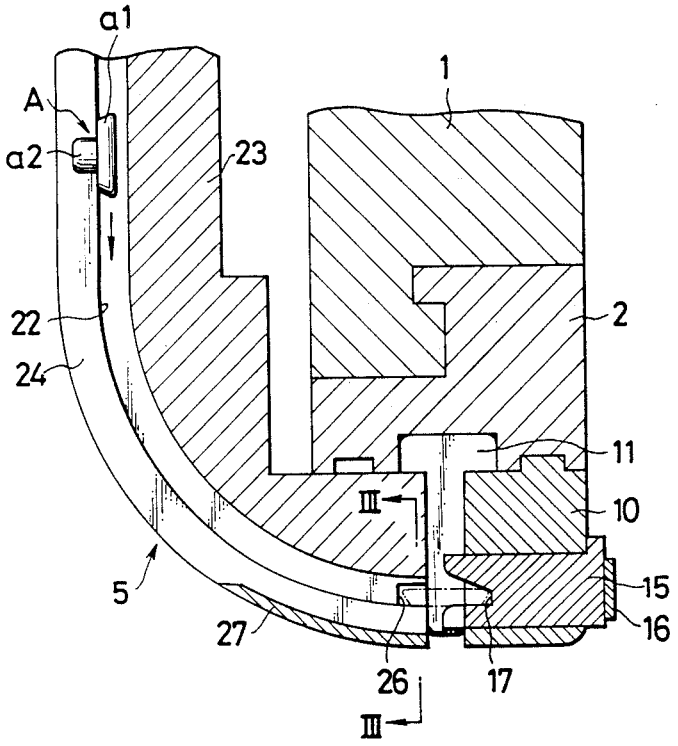
FIG. 2 is an enlarged cross-sectional view taken along line II—II of FIG. 1.

FIG. 1 shows an apparatus for conveying upper fastener members A one at a time to an upper or punch unit 3 of an automatic fastener-assembling machine for joining the upper fastener member A with a companion lower fastener member (not shown), with a garment fabric (not shown) disposed between the upper and lower fastener members. In the illustrated embodiment, the upper fastener member A is a button that is to be joined with a tack (not shown). As best shown in FIG. 2, the button A has a head a1 and a hollow shank a2 projecting centrally therefrom.

The apparatus generally comprises a base 2 fixed to a frame 1 of the fastener-assembling machine, a chute 5 fixed to the frame 1 for conveying a succession of button A downwardly from a non-illustrated hopper, and a horizontal guide (described below) supported on the base 2 and extending between the lower end portion of the chute 5 and the upper unit 3 for conveying the buttons A one at a time from the chute 5 to the upper unit 3.

Figure 3:
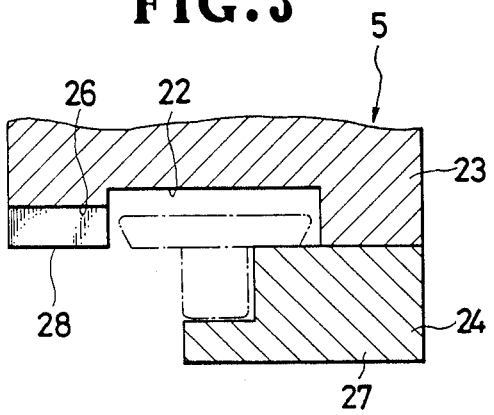
FIG. 3 is an enlarged cross-sectional view taken along line III—III of FIG. 2.

As shown in FIGS. 1 through 3, the chute 5 includes a chute body 23 of generally C-shaped cross section, and a pair of parallel cover plates 24, 25 extending on and along the chute body 23 with a constant gap between their confronting inner edges. Thus the chute body 23 and the two cover plates 24, 25 jointly define a first passageway 22 of generally T-shaped cross section through which a succession of buttons A is slidably received. One of the cover plates 24, which is remote from the upper unit 3, has a projection 27 extending from its lower end portion toward the other cover plate 25. The other cover plate 25 has a cutout 28 (FIGS. 1, 3, 6, 7) at its lower end portion in which cutout an auxiliary cover 32 (FIGS. 1, 6 and 7) is detachably received for a purpose described below.

Figure 4:
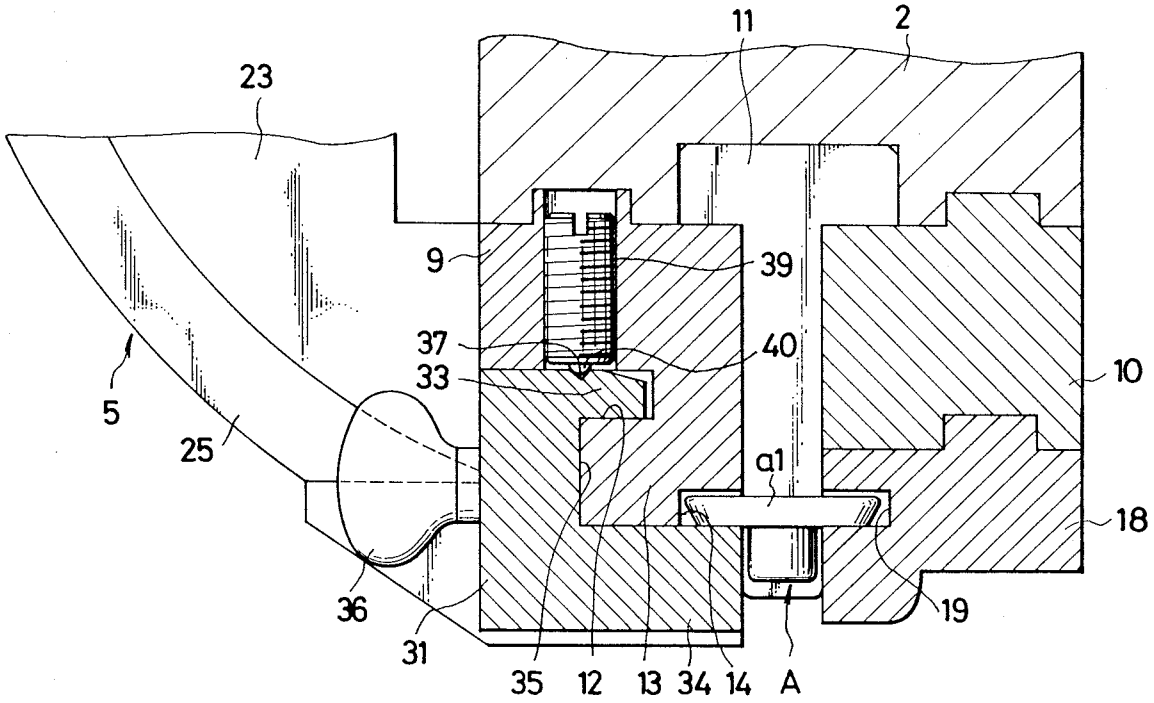
FIG. 4 is an enlarged cross-sectional view taken along line IV—IV of FIG. 1.

As shown in FIGS. 1 and 4, the guide includes front and rear parallel guide blocks 9, 10 fixed to the base 2, a rear guide part 18 fixed to the underside of the rear guide block 10, and a front guide part 31 detachably mounted on the underside of the front guide block 9. The base 2, the front and rear guide blocks 9, 10, and the front and rear guide parts 31, 18 jointly define a longitudinal guide channel of a T-shaped cross section in which a reciprocating elongated pusher 11 is slidably received. This guide channel includes a second passageway 4 communicating with the first passageway 22. As the pusher 11 reciprocates in the guide channel, the buttons A are received one at a time from the first passageway 22 into the second passageway 4 and then guided through the second passageway 4. The rear guide part 18 has in its inner surface a first groove 19, while the front guide block 9 and the front guide part 31 jointly define in their combined inner surface a second groove 14; the first and second grooves 19, 14 jointly serve to guide the head a1 of a button A.

As best shown in FIG. 4, the front guide part 31 has a generally C-shaped cross section having inwardly directed first and second longitudinal projections 33, 34 defining therebetween a first longitudinal recess 35. The front guide block 9 also has a generally C-shaped cross section having an outwardly directed third longitudinal projection 13 and a second longitudinal recess 12. As the front guide part 31 is coupled with the front guide block 9, the first longitudinal projection 33 of the front guide part 31 is received in the second longitudinal recess 12 of the front guide block 9, and the third longitudinal projection 13 of the front guide block 9 is received in the first longitudinal recess 35 of the front guide part 31. A knob 36 is fixed to a front or outer surface of the front guide part 31, facilitating removal of the front guide part 31 from the front guide block 9.

The front guide part 31 has a V-shaped groove 37 (FIGS. 1 and 4) extending in its top surface along the entire length thereof, and a central channel-shaped groove 38 (FIGS. 1 and 5) extending transversely across the top surface. A pair of ball plungers 39, 39 is fixed to the front guide block 9; a ball 40 resiliently projects from a lower end of each ball plunger 39 into the V-shaped groove 37 of the front guide part 31 to thereby prevent accidental removal of the front guide part 31.

A threaded pin 41 is fixed to the front guide block 9 and projects into the central channel-shaped groove 38 of the front guide part 38, facilitating positioning of the front guide part 38.

As shown in FIG. 2, a fastener catcher 15 is transversely slidably supported by the rear guide block 10 in confronting relation to the lower end of the first passageway 22 of the chute 5. The fastener catcher 15 has in its inner surface a recess 17 receptive of a part of the head a1 of a button A from the chute 5. The fastener catcher 15 is normally urged by a leaf spring 16 inwardly so as to normally project into the T-shaped guide channel through which the pusher 11 is reciprocably received. As the pusher 11 is moved forwardly (rightwardly in FIG. 1) past the fastener catcher 15, the fastener catcher 15 is retracted from the T-shaped guide channel against the bias of the spring 16. When the pusher 11 is returned to its fully retracted position upstream of the fastener catcher 15 after having pushed a button A to the upper unit 3, the fastener catcher 15 is also returned under the bias of the spring 16 to project into the guide channel for receiving a succeeding button A from the chute 5.

Figure 5:
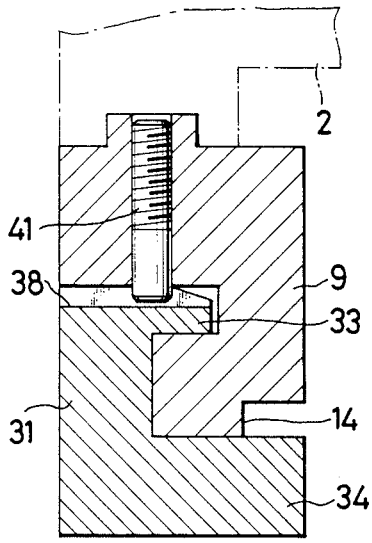
FIG. 5 is an enlarged cross-sectional view taken along line V—V of FIG. 1.

The chute body 23 has in its lower end portion a recess 26 (FIGS. 2, 3 and 7) horizontally communicating with the second groove 14 (FIGS. 4 and 5). This recess 26 of the chute body 23 and the recess 17 of the fastener catcher 15 jointly serve to receive the head a1 of a button A in horizontal posture.

Figure 7:
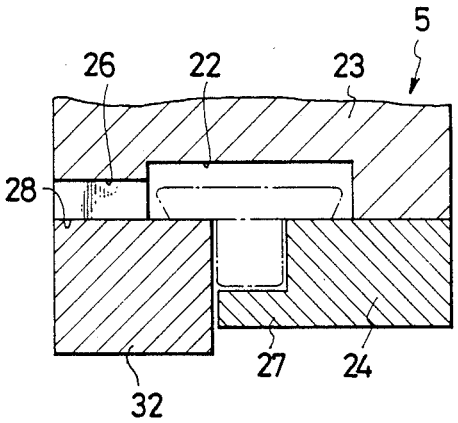
FIG. 7 is an enlarged cross-sectional view taken along line VII—VII of FIG. 6.
Figure 6:
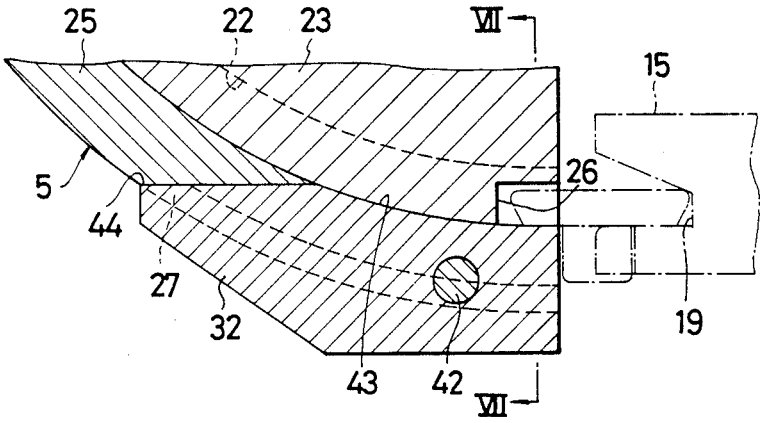
FIG. 6 is an enlarged cross-sectional view taken along line VI—VI of FIG. 1.

As shown in FIGS. 1 and 6, the auxiliary cover 32 is complementary in shape to the cutout 28 of the lower end portion of the chute 5. The cover 32 has on its upper side a curved surface 43 contractable with a lower surface of the chute body 23 and a horizontal surface 44 contractable with a lower end surface of the cover plate 25. The curved surface 44 of the auxiliary cover 32 and an inner surface of the cover plate 24 jointly serve to support the head a1 of a button A, as shown in FIG. 7. The auxiliary cover 32 is fixed to one end of the front guide part 31 by means of a screw 42.

With the apparatus thus constructed, a button A that is jammed in the guide or at the junction between the guide and the chute 5, can be removed in the following manner:

In the case where a button A is jammed anywhere in the guide, the front guide part 31 is removed from the front guide block 9 by pulling the knob 36, thus making the entire length of the second passageway 4 open or exposed. With the removed front guide part 31 placed aside, the jammed button A is removed out of the second passageway 4 by using both hands.

In the case where a button A is jammed at the junction between the chute 5 and the guide, the front guide part 31 is removed from the front guide block 9 by pulling the knob 36, thus making the entire length of the second passageway 4 open or exposed. At that time, since it is fixed to the front guide part 31, the auxiliary cover 32 is removed from the chute 5 together with the front guide part 31, thus making the junction between the chute 5 and the guide open or exposed. With the removed front guide part 31 and the auxiliary cover 32 placed aside, the jammed button A is removed from the junction between the chute 5 and the guide through the cutout 28 by using both hands.

Alternatively, the auxiliary cover 32 may be separate from the front guide part 31 so that the auxiliary cover 32 and the front guide part 31 can be removed independently of each other.

According to the present invention, since a front part of the guide is detachable to make the second passageway open or exposed along its entire length, a button jammed anywhere in the second passageway can be removed by both hands. Further, since a lower front part of the chute is detachable to make the junction between the first and second passageways open or exposed, a button jammed at the junction can be removed by both hands.

Although various minor modifications may be suggested by those versed in the art, it should be understood that I wish to embody within the scope of the patent warranted hereon, all such embodiments as reasonably and properly come with the scope of my contribution to the art.

What is claimed is:

1. A fastener conveying apparatus for an automatic fastener assembling machine having an upper unit, said apparatus comprising:

(a) a base;

(b) a chute fixed to said base and defining a first passageway for guiding therethrough a plurality of fastener members in succession;

(c) a guide supported on said base and defining a second passageway extending between a lower end portion of said first passageway and the upper unit of the fastener assembling machine for receiving from said first passageway the fastener members one at a time and for guiding the individual fastener member through said second passageway;

(d) a pusher reciprocable in said guide for pushing the fastener member in said second passageway toward the upper unit of the fastener assembling machine; and (e) said guide including front and rear parallel guide blocks fixed to said base, a rear guide part fixed to an underside of said rear guide block, and a front guide part detachably mounted on an underside of said front guide block, wherein said front guide part has in its top surface a longitudinal V-shaped groove into which balls of at least two ball plungers fixed to said front guide block normally resiliently project.

2. A fastener conveying apparatus according to claim 1, wherein said chute has a cutout in a front cover plate at a lower end thereof, and an auxiliary cover detachably received in said cutout.

3. A fastener conveying apparatus according to claim 2, wherein said auxiliary cover is fixed to said front guide part.

4. A fastener conveying apparatus according to claim 1, wherein said front guide part has a generally C-shaped cross section having inwardly directed first and second longitudinal projections defining therebetween a first longitudinal recess, and said first guide block having a generally C-shaped cross section having an outwardly directed third longitudinal projection engageable in said first longitudinal recess and a second longitudinal recess in which said first longitudinal projection is engageable.

5. A fastener conveying apparatus according to claim 1, wherein said front guide part has in its top surface a transverse channel-shaped groove into which a pin fixed to said front guide block projects.

6. A fastener conveying apparatus according to claim 1, wherein said front guide part is further removable from said front guide block in a direction laterally away from said rear guide part.

7. A fastener conveying apparatus according to claim 1, wherein said front guide part has a knob fixed to its front surface.

* * * * *